US005127657A

United States Patent [19]

Ikezawa et al.

[11] Patent Number: 5,127,657

[45] Date of Patent: Jul. 7, 1992

[54] AMUSEMENT SYSTEM

[75] Inventors: Mamoru Ikezawa; Keiji Mochino, both of Tokyo, Japan

[73] Assignees: Namco, Ltd.; Togo Japan, Inc.; N & T Co., Ltd.; Akatsukikougei Kabushiki Kaisha, all of Tokyo, Japan

[21] Appl. No.: 588,550

[22] Filed: Sep. 26, 1990

[30] Foreign Application Priority Data

Sep. 29, 1989 [JP] Japan ..... 1-254016

[51] Int. Cl.[5] ..... A63B 67/00

[52] U.S. Cl. ..... 273/310; 273/312; 273/313; 273/316; 434/21; 472/1; 472/62

[58] Field of Search ..... 272/2, 17, 19, 29; 434/21, 22; 273/856, 310, 311, 312, 365, 367, 313, 314, 316

[56] References Cited

U.S. PATENT DOCUMENTS

| | | | |
|---|---|---|---|
| 572,142 | 12/1896 | Williams | 272/19 |
| 2,364,699 | 12/1944 | Eastman | 272/41 |
| 3,877,157 | 4/1975 | Ashford et al. | 434/22 |
| 3,949,679 | 4/1976 | Barber | 104/63 |
| 4,154,440 | 5/1979 | Rusk | 272/19 |
| 4,192,507 | 5/1980 | Rains et al. | 273/311 |
| 4,296,929 | 10/1981 | Meyer et al. | 273/310 |
| 4,340,370 | 7/1982 | Marshall et al. | 434/22 |
| 4,342,556 | 8/1982 | Hasse | 434/21 |
| 4,561,849 | 12/1985 | Eichweber | 434/22 |
| 4,619,615 | 10/1986 | Kratzenberg | 434/22 |
| 4,662,845 | 5/1987 | Gallagher et al. | 434/22 |
| 4,772,028 | 9/1988 | Rockhold et al. | 273/311 |
| 4,830,381 | 5/1989 | Sellner | 434/22 |
| 4,948,371 | 8/1990 | Hall | 434/21 |

FOREIGN PATENT DOCUMENTS

| | | | |
|---|---|---|---|
| 1308343 | 5/1987 | U.S.S.R. | 272/19 |

*Primary Examiner*—Benjamin Layno
*Assistant Examiner*—Jessica J. Harrison
*Attorney, Agent, or Firm*—Oliff & Berridge

[57] ABSTRACT

The present invention provides an amusement system having a play zone consisting, in combination, of a plurality of game stages and including a travel path extending through the respective game stages; at least one carrier for receiving a player or players thereon and for moving along the travel path while causing the player or players to play a game at each of the game stages; a score processor for processing the score of the player or the scores of the players; and a representing device for representing the game in each of the game stages, the representing device providing a multi-story game by changing the game presentation mode at a game stage through which the carrier is moving or will move, depending on the total carrier score won by the player or players on the carrier.

16 Claims, 11 Drawing Sheets

G
ROOM COMMUNICATION UNIT
52
54
INFRARED COMMUNICATION
DOOR
DOOR
46
46
12
62
RAM
COMPUTER
60
SCORE
TREASURE
SPEAKER
74
POWER SOURCE
COLLECTOR
40
70
66
10
68
CARRIER COMMUNICATION UNIT
42
64
44
58a
58b
T
T
T
ROOM COMPUTER
50
SYSTEM CONTROL COMPUTER
22
REPRESENTATION CONTROL COMPUTER
56
FROM 40
CARRIER CONTROL
26

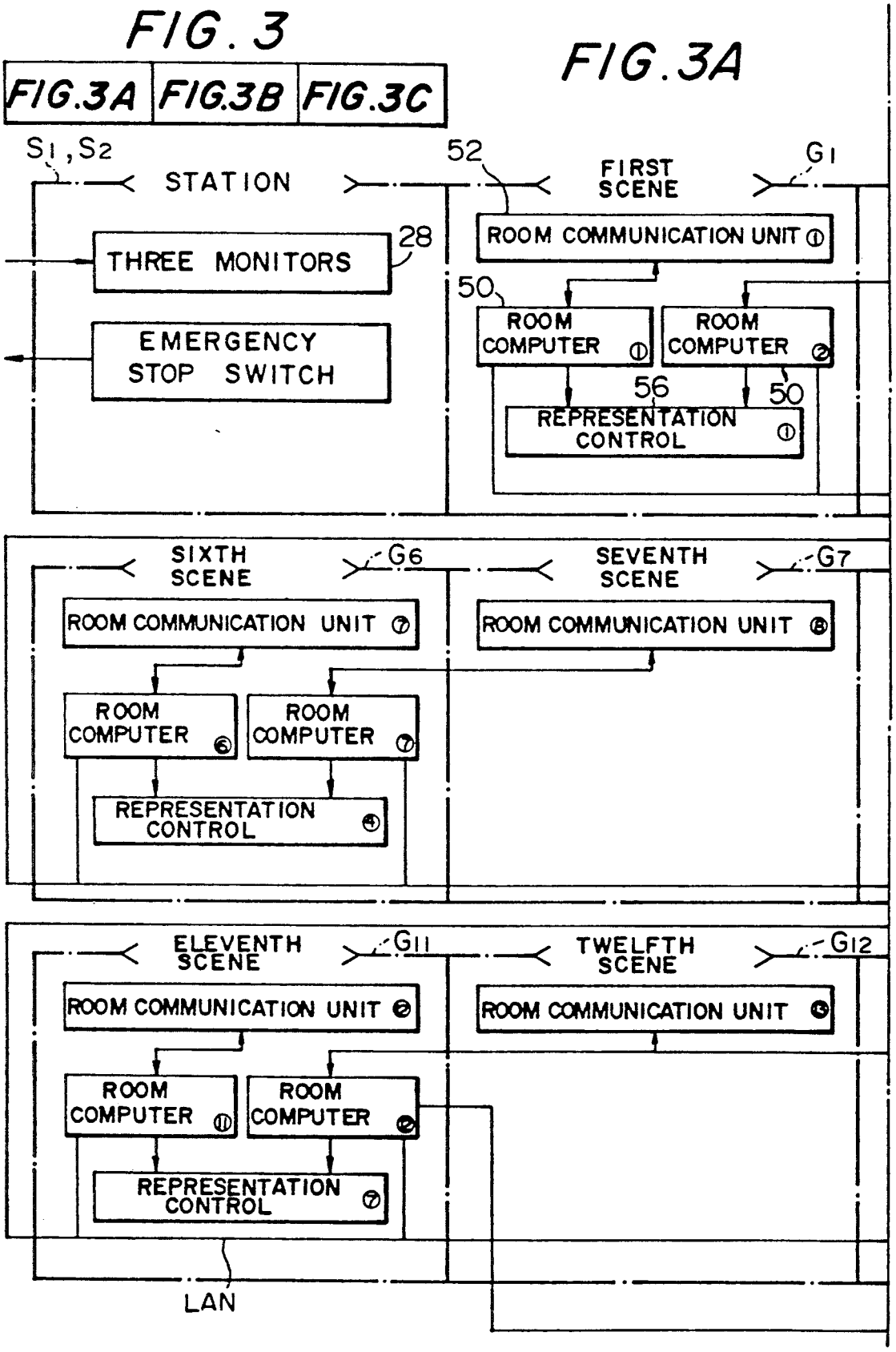
FIG. 3
FIG.3A
FIG.3B
FIG.3C
FIG.3A
S1, S2
STATION
THREE MONITORS
28
EMERGENCY STOP SWITCH
52
FIRST SCENE
G1
ROOM COMMUNICATION UNIT ①
50
ROOM COMPUTER ①
ROOM COMPUTER ②
56
50
REPRESENTATION CONTROL ①
SIXTH SCENE
G6
ROOM COMMUNICATION UNIT ⑦
ROOM COMPUTER ⑥
ROOM COMPUTER ⑦
REPRESENTATION CONTROL ⑥
SEVENTH SCENE
G7
ROOM COMMUNICATION UNIT ⑧
ELEVENTH SCENE
G11
ROOM COMMUNICATION UNIT ⑫
ROOM COMPUTER ⑪
ROOM COMPUTER ⑫
REPRESENTATION CONTROL ⑦
TWELFTH SCENE
G12
ROOM COMMUNICATION UNIT ⑬
LAN

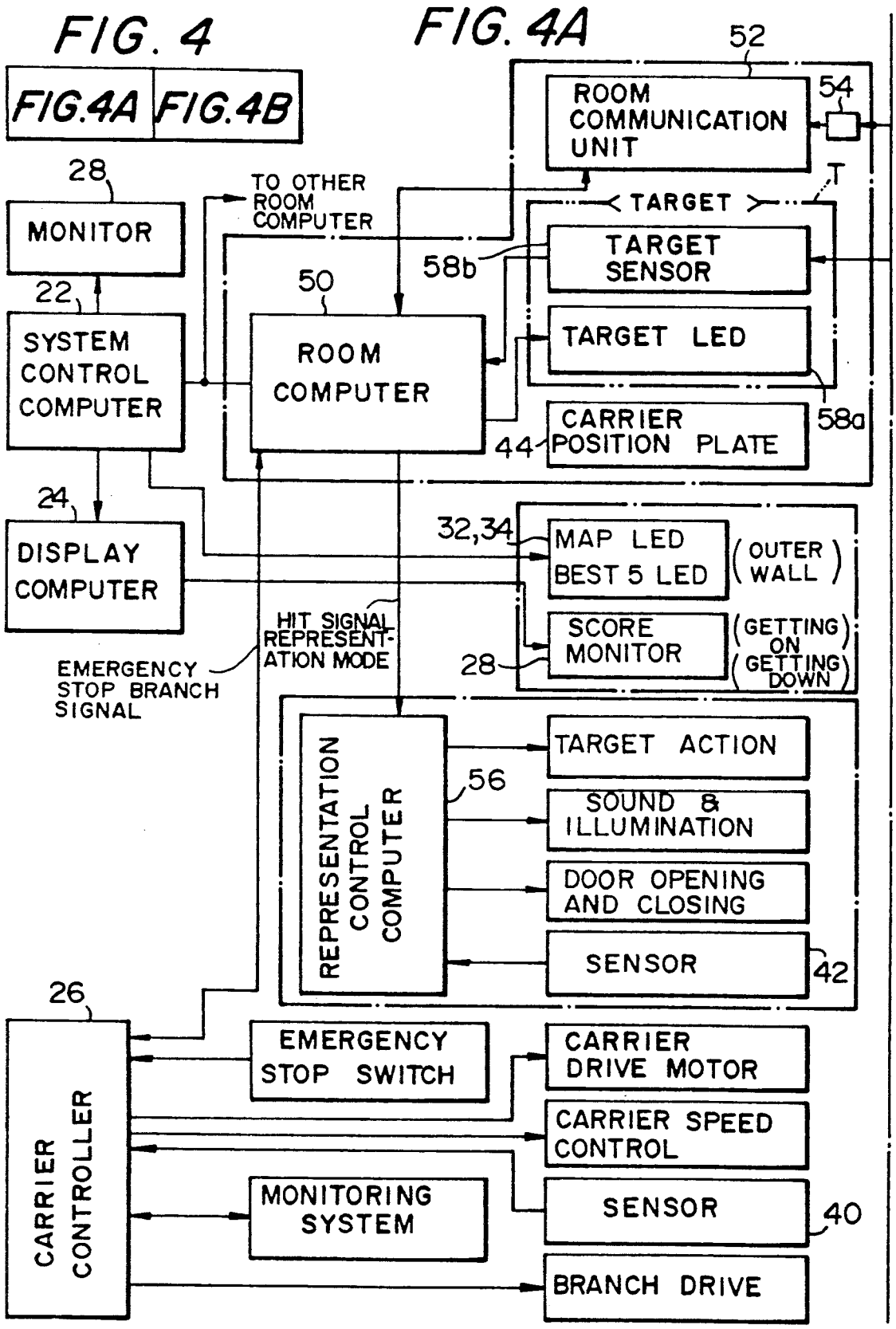
FIG. 4
FIG.4A
FIG.4B
FIG. 4A
52
ROOM COMMUNICATION UNIT
54
28
MONITOR
TO OTHER ROOM COMPUTER
TARGET
T
58b
TARGET SENSOR
22
50
SYSTEM CONTROL COMPUTER
ROOM COMPUTER
TARGET LED
CARRIER POSITION PLATE
58a
44
24
DISPLAY COMPUTER
32,34
MAP LED
BEST 5 LED
(OUTER WALL)
HIT SIGNAL REPRESENTATION MODE
SCORE MONITOR
(GETTING ON GETTING DOWN)
28
EMERGENCY STOP BRANCH SIGNAL
REPRESENTATION CONTROL COMPUTER
56
TARGET ACTION
SOUND & ILLUMINATION
DOOR OPENING AND CLOSING
SENSOR
42
26
EMERGENCY STOP SWITCH
CARRIER DRIVE MOTOR
CARRIER CONTROLLER
CARRIER SPEED CONTROL
MONITORING SYSTEM
SENSOR
40
BRANCH DRIVE INFRARED COMMUNICATION
68
CARRIER COMPUTER
CARRIER COMMUNICATION UNIT
66
60
70
COCKPIT GUN
70b
INFRARED EMISSION
70c
FIRE DISPLAY
70a
TRIGGER
COMPUTER
DISPLAY PANEL
MY SCORE
TOTAL CARRIER SCORE
TREASURES (SEVEN)
KNIGHTS (THREE)
POWER ON/OFF
74
STATION START
RAM
SCENE START/ END SENSOR
64
62
SOUND
SOUND SYNTHESIZER
BATTERY
COLLECTOR

CONTENTS OF DISPLAY: TOTAL CARRIER SCORE
CARRIER NUMBER

AMUSEMENT SYSTEM

BACKGROUND OF THE INVENTION

1. Field of the Invention

The present invention relates to an amusement system and particularly to an amusement system in which players can play a game on the respective carriers moving along a given path within a play zone.

2. Description of the Related Art

There are known such a kind of game playing systems, one of which comprises Galaxy railroad adventure trains each traveling round within a play zone for about 2 or 3 minutes and target display means for representing a cluster of UFO's and huge space monsters as targets around the railroad.

In such a game playing system, each of the trains on which a player or players are getting first moves through a cluster of UFO's. Each of UFO's includes a photosensor which will produce a certain sound when it is hit by a light beam from a beam gun manipulated by the player.

After passed through the cluster of UFO's, a cluster of huge space monsters then appear around the moving train. Each of these space monsters also includes a photosensor which, when it is hit by the light beam from the beam gun, causes a hit space monster to move or lash out.

The players will return to the space station after they have fought against the cluster of UFO's and space monsters while getting on the trains.

Such a para-experience type amusement system provides a new and much more amusing shooting game since players can shoot targets successively appearing in a playing space while moving within the playing space.

In the prior art, however, the players on the train only shoot and hit the targets without counting of their scores. Therefore, the prior art amusement system lacks a lot of fun in competition.

The amusement system as aforementioned has a problem in that it easily causes the players to loose interest in playing the game since the game is played by the players only in a single representation mode.

In view of the fact that such an amusement system is large-scaled and expensive, it is desirable to provide new amusement which will cause players to interest in playing a game.

SUMMARY OF THE INVENTION

It is therefore an object of the present invention to provide a new and novel amusement system which can cause a player on a train traveling along a given path in a play zone to enjoy a game while confirming his score and yet which will not easily cause the player to have lost interest in playing the game by changing one representation mode to another, even though the player plays the same game repeatedly.

To this end, the present invention provides an amusement system comprising:

a play zone including a plurality of game stages in combination and a travel path extending through said game stages;

carrier means for receiving a player or players thereon, said carrier means being movable on and along said travel path while causing the player or players to play a game;

score computing means for processing the score obtained by each player; and means for representing the game in each of said game stages, said representing means being adapted to change the game from one game representation mode to another in a game stage through which said carrier means is being moved or another game stage through which said carrier means will be moved subsequently, depending on the processed score for each player.

The operation of such an amusement system according to the present invention will now be described as to when it is applied to a shooting game.

In the amusement system of the present invention, the play zone includes a plurality of game stages in combination.

At each time when the player or players on the carrier means are being moved through each of the game stages, targets are displayed depending on a game representation mode at that time.

If a player shoots and hits any target by the use of any suitable gun, the score computing means will be count to provide his score at that time point.

In such a manner, the amusement system of the present invention can provide a substantially real feel in shooting to the player when he shoots and/or hits targets while getting on the carrier means moving within the game zone and yet provide a very increased amusingness in the shooting game since a plurality of players can compete in their scores with each of the players confirming his own score substantially at real time.

In addition, the present invention is characterized in that the game representation mode is changed from one game representation mode to another in a game stage through which said carrier means is being moved or another game stage through which said carrier means will be moved subsequently, depending on the processed score for each player.

One means for changing the game representation mode is that any one of the game stages is constructed to be variable in game representation mode. Thus, the game representation mode may be simply changed in the variable mode stage at each time when the carrier means is moving or will move through that variable mode stage, depending on the computed score of each player on the carrier means.

The other means for changing the game representation mode may be that the travel path is branched at a given point into a different travel path along which the carrier means can run. Depending on the score of the player or players, the carrier means may be conducted onto any selected one of the travel paths along which the carrier means will move through a game stage with a different representation mode.

Since the game representation mode is changed from one game representation mode to another depending on the player's score during playing, the present invention can cause the player to play the game with new excitation and amusingness even if the same player plays the game repeatedly.

BRIEF DESCRIPTION OF THE DRAWINGS

FIGS. 1 through 10 illustrate a first preferred embodiment of an amusement system constructed in accordance with the present invention FIG. 1 illustrates the relationship between a control circuit in each of the game stages and various instruments in a carrier.

FIG. 2 illustrates the travel path of the carrier in a play zone consisting of a plurality of game stages.

FIGS. 3, 3A, 3B and 3C are block diagrams of the circuitry used in the amusement system according the first embodiment of the present invention.

FIGS. 4, 4A and 4B illustrate the entire system constructed of the game stages and a central control room.

FIG. 5 illustrates one game representation in a given game stage.

FIG. 6 illustrates the concrete form of a beam gun in each carrier.

FIG. 7 illustrates a score display panel in each carrier.

FIG. 8 illustrates one display used in a station platform at which the players get on and off the carrier.

FIGS. 9 and 10 illustrate displays on the outer wall of a building defining the play zone.

DETAILED DESCRIPTION OF PREFERRED EMBODIMENTS

Figure 2:
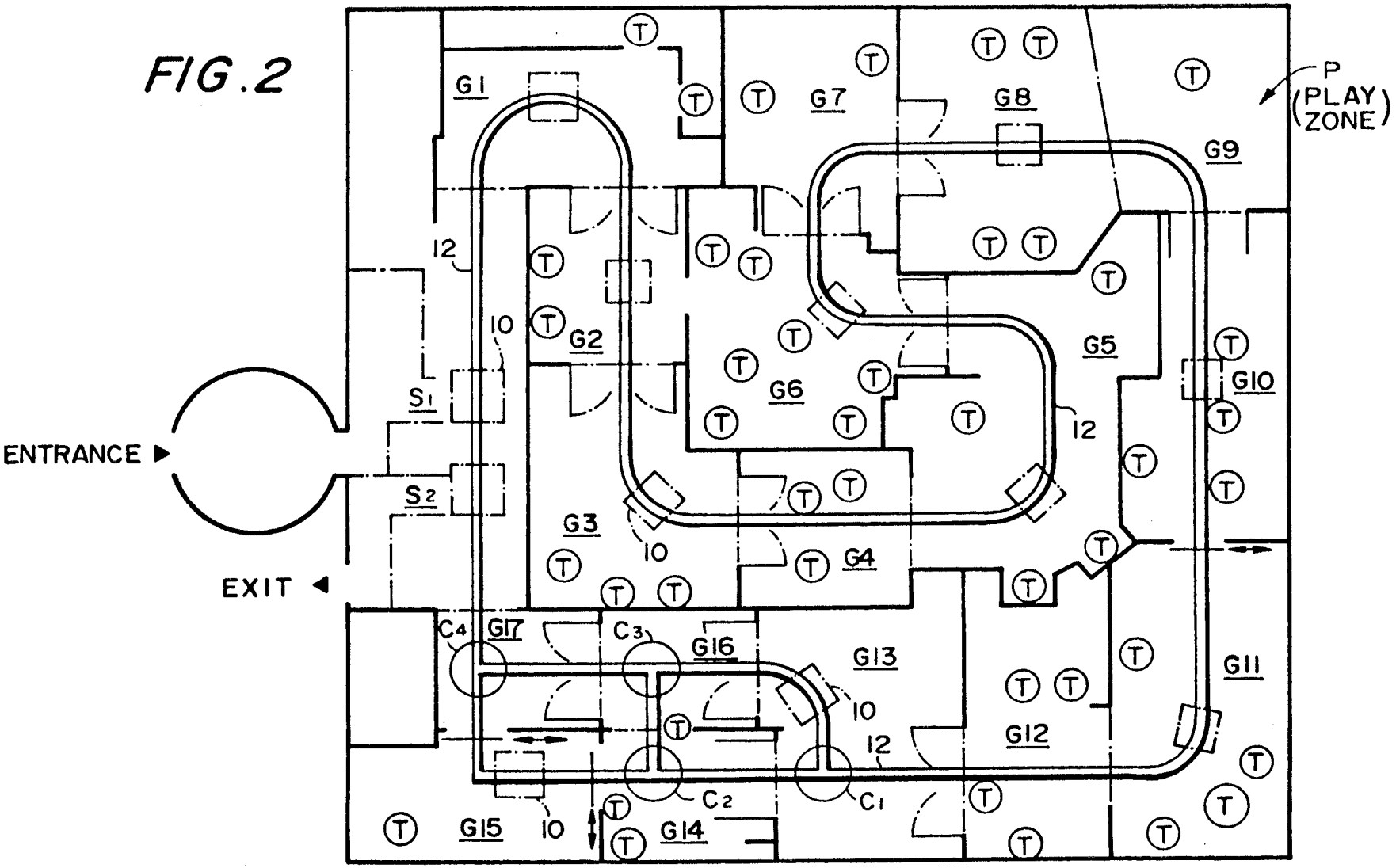

Referring first to FIG. 2, there is shown a preferred embodiment of an amusement system constructed in accordance with the present invention. The amusement system comprises a play zone P and a plurality of game stages $G_1$, $G_2$, ..... $G_{17}$.

Each of the game stages $G_1$–$G_{17}$ is set in an individual room and have a different game representation mode from game representation modes in the other game stages In addition, each of the game stages $G_1$–$G_{15}$ is provided with targets T compatible with its game representation mode.

The amusement system further comprises a plurality of carriers 10, each of which starts at a getting-on station $S_1$, moves on a rail 12 sequentially through the first game stage $G_1$ to the seventeenth game stage $G_{17}$, and finally returns to a getting-off station $S_2$. During the movement of the carrier 10, a player thereon can shoot the targets T through his shooting device. If a target T is hit, it generates a hit signal which in turn is wireless transmitted to the carrier 10. When the carrier 10 receives the hit signal, it displays the counted score of the player. Each of the game stages $G_{13}$, $G_{14}$, $G_{16}$ and $G_{17}$ includes a branch table $C_1$, $C_2$, $C_3$ or $C_4$. Two of these branch tables $C_1$ and $C_2$ are used to divide the rail 12 into two branch rail sections while the remaining branch tables $C_3$ and $C_4$ are used to merge the two branch rail sections into the rail 12.

Figure 3B:
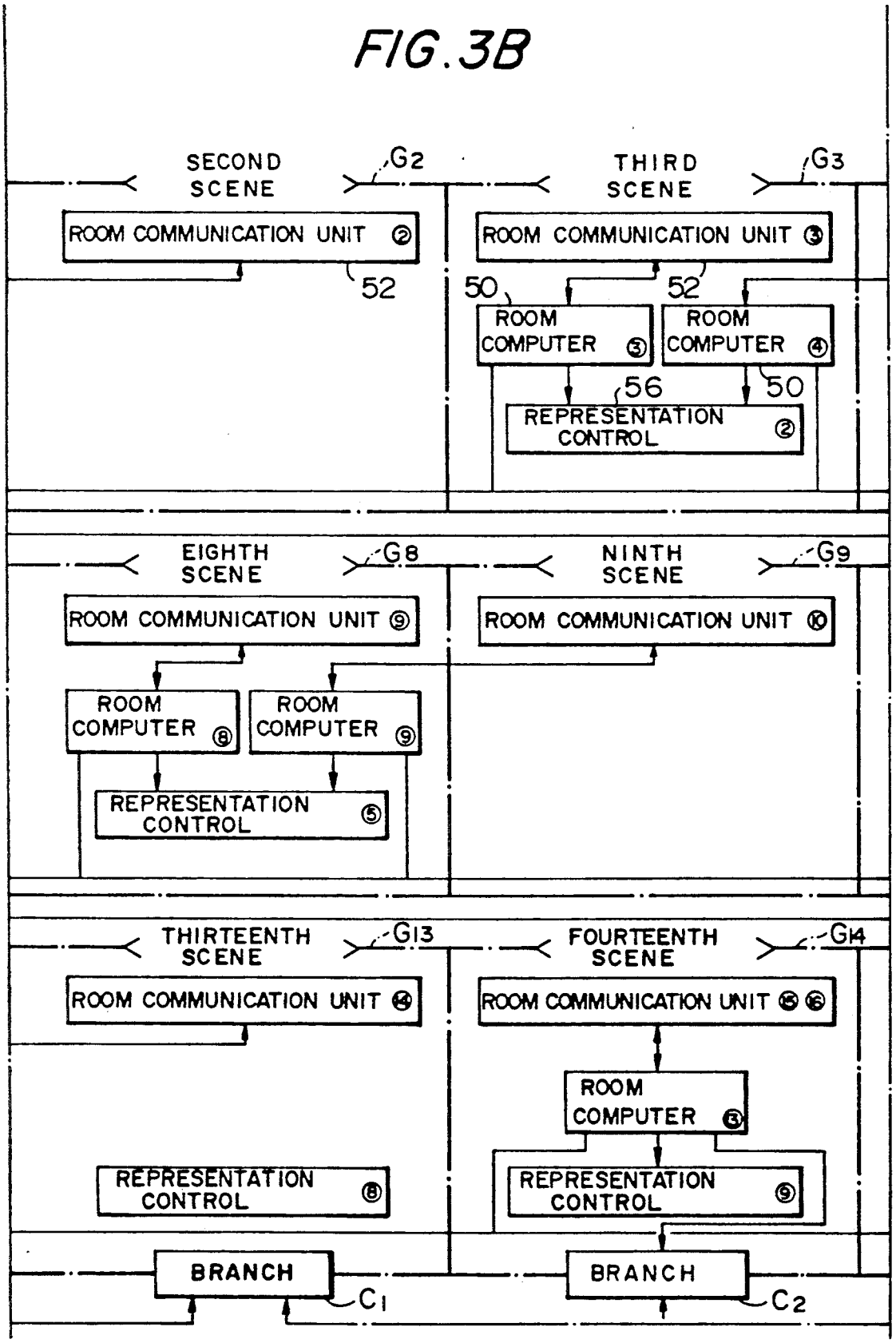
Figure 3C:
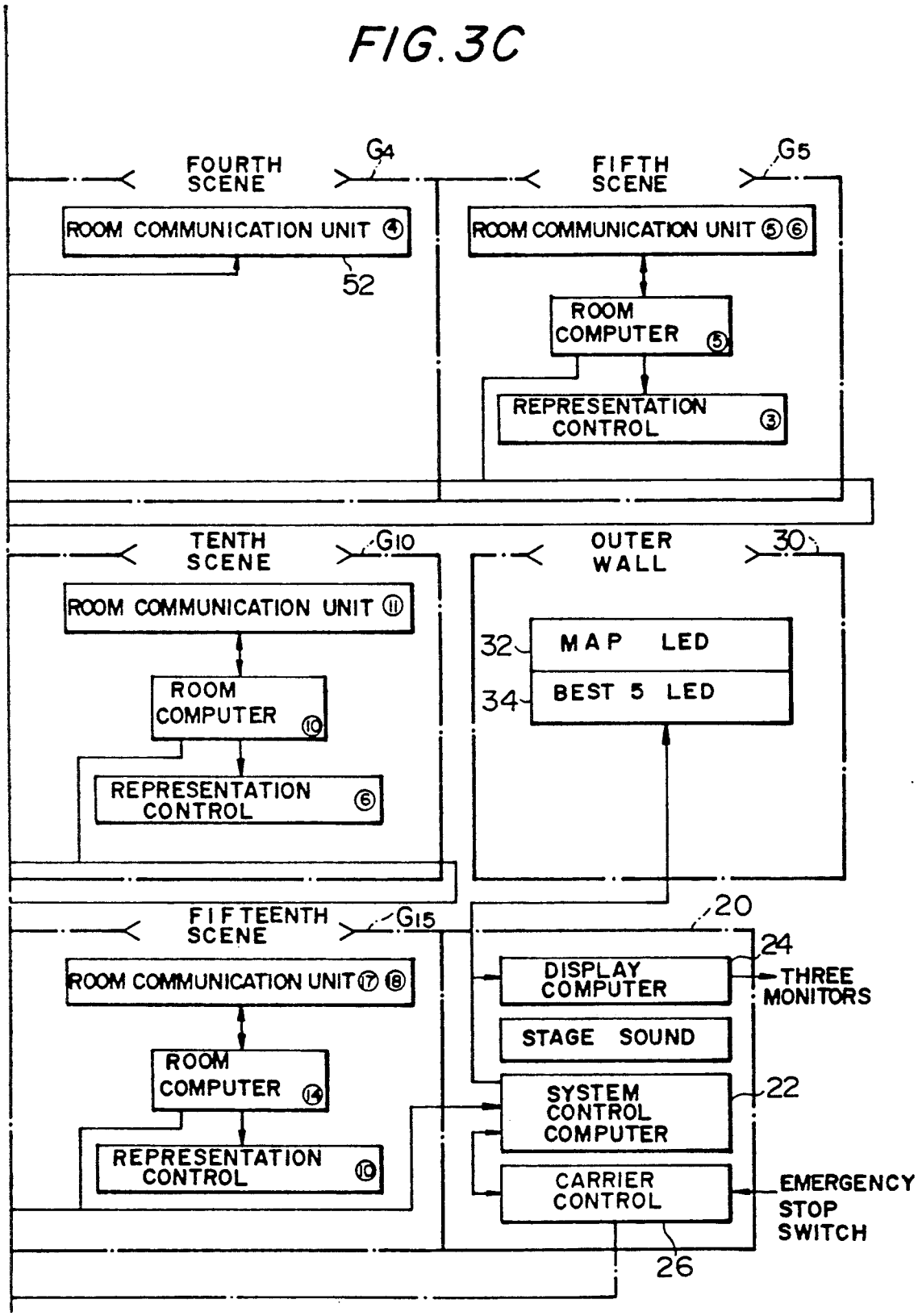
Figure 4B:
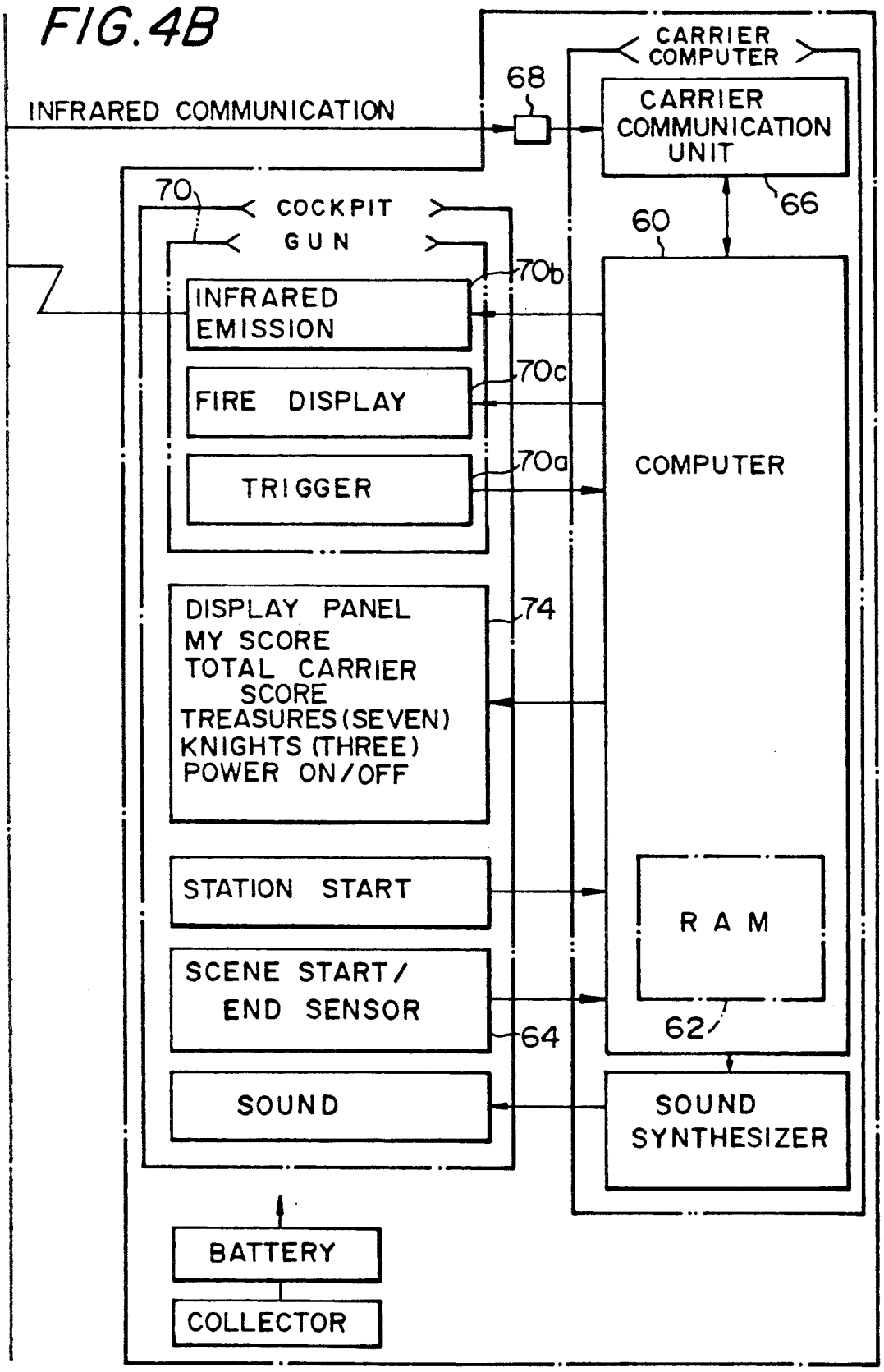

FIG. 3 shows the relationship between the game stages $G_1$–$G_{15}$ in the first preferred embodiment while FIG. 4 shows the circuitry of said system in details.

Referring to FIG. 3, including FIGS. 3A, 3B and 3C, the amusement system further comprises a central control room 20 in addition to the game stages $G_1$–$G_{15}$. The central control room 20 includes a system control computer 22, a display computer 24 and a carrier controller 26.

The system control computer 22 is connected with the circuits of the respective game stages $G_1$–$G_{17}$ through LAN for transmission of data therebetween.

The carrier controller 26 is adapted to control the movement of the respective carriers 10 on and along the rail 12 and to control the operation of the branch tables $C_1$–$C_4$. More particularly, the carriers 10 are not self propelled, but are supplied with a drive power from the rail 12. The rail 12 includes, at preselected positions, carrier position sensors 40 (FIG. 1) each for sensing the position of a moving carrier on the rail 12. When the carrier controller 26 receives a detection signal from each of the sensors 40, the controller 26 controls the speed of each of the moving carriers 10.

Figure 1:
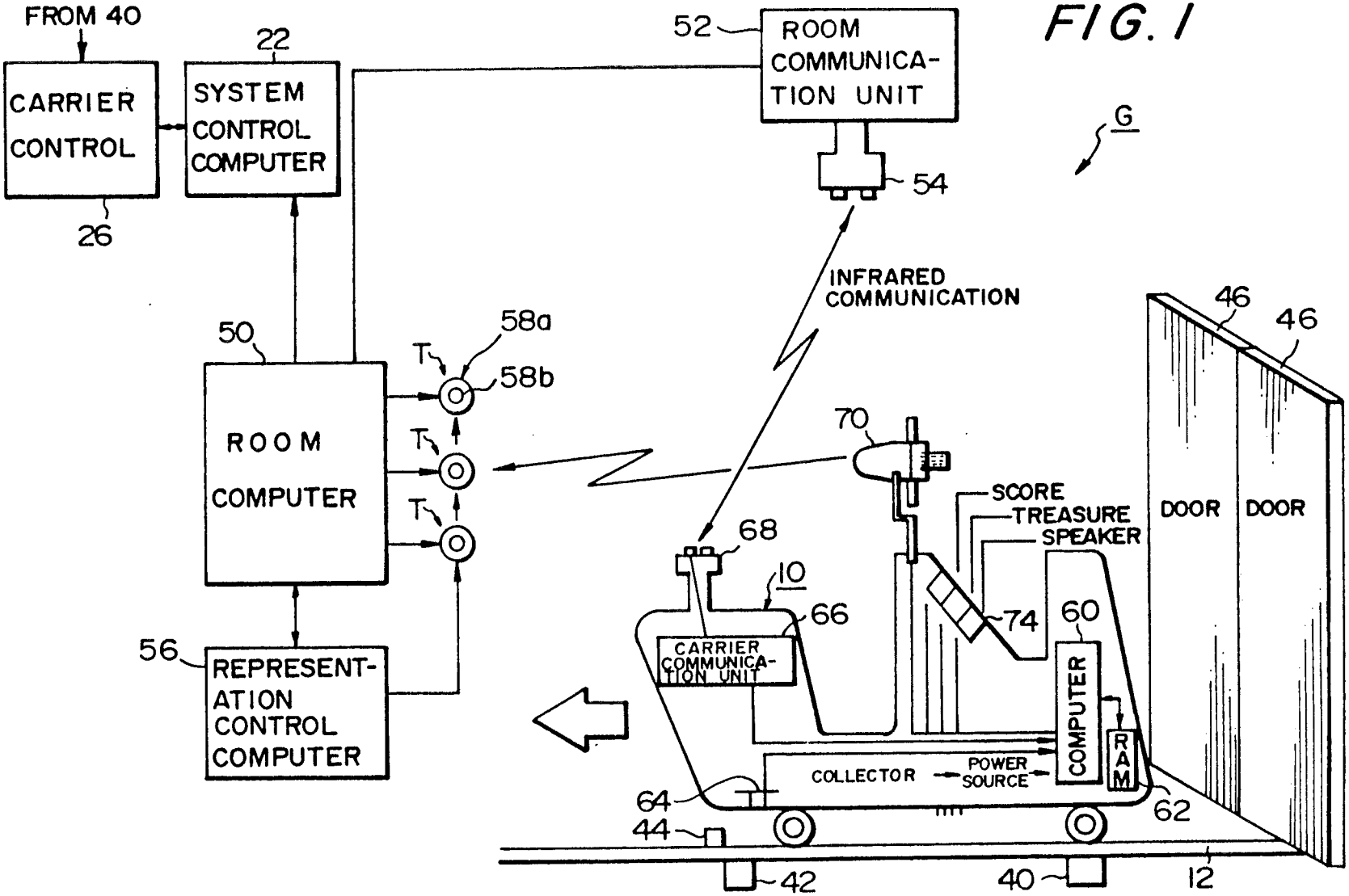

As seen from FIG. 1, each of the game stages G includes, in principle, a room computer 50, a room communication unit 52 and an infrared transmitter-receiver 54. A representation control computer 56 is further provided, in principle, one for two game stages.

FIG. 1 shows part of the arrangement of a game stage G and also the concrete structure of a carrier 10.

Each of the game stages G is provided, at its entrance, with a sensor 42 for detecting the entry of each carrier 10 and a carrier position plate 44. When the sensor 42 detects the entry of a carrier 10, it generates a detection signal which is supplied to the representation control computer 56. On receiving the detection signal from the sensor 42, the representation control computer 56 then initiates a game representation in that game stage G.

Figure 5:
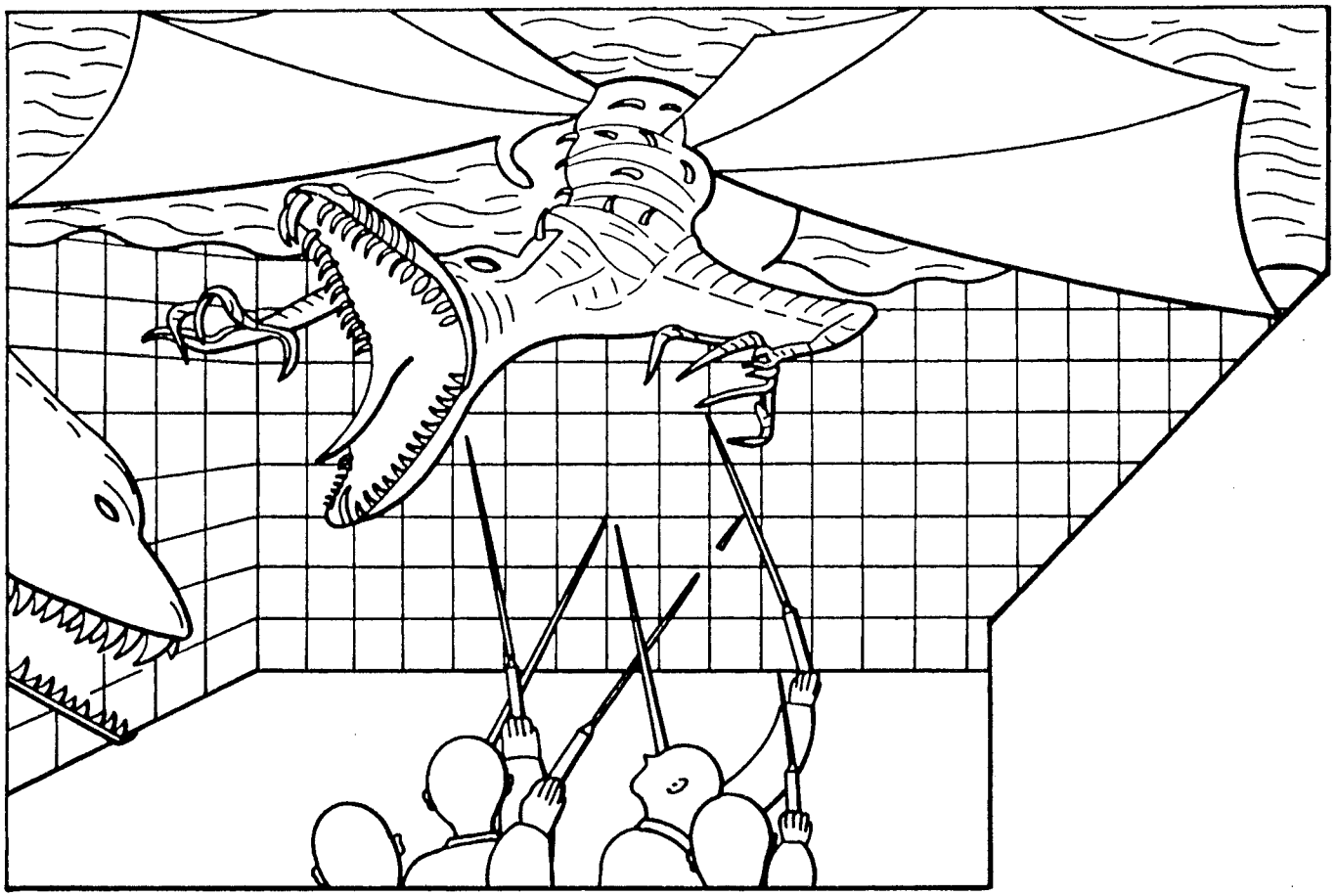

In the illustrated embodiment, such a game representation is accomplished by sequentially controlling variable components, such as targets T, sounding instruments, illuminating lamps, doors 46 and others, in accordance with preselected game processing modes As shown in FIG. 5, the processing of game may be carried out, for example, by controlling the behavior of monsters attacking the player with sound and illumination.

In this connection, for example, each of the monsters may have some vital points at its eyes, arm roots and others, which vital points are set as targets T. As shown in FIG. 1, each of the targets T includes an LED 58*a* for indicating the position of that target and an infrared sensor 58*b* for detecting the beam of a gun manipulated by the player. If any one of the vital points is hit by the beam, the count belonging to that player will be incremented.

Each of the carriers 10 further comprises a computer 60 for processing the score of the player; a RAM 62 for storing the score of the player; a sensor 64 for sensing the entry and exit of a carrier 10 in a game stage at each time when that carrier 10 moves past the carrier position plate 44; a communication unit 68; a beam gun 70 adapted to direct a beam of infrared against the targets T; and a score display panel 74 for displaying the score of the player in the game.

In the illustrated embodiment, a carrier 10 has seats on which four players sit. Therefore, each of the seats will include a beam gun 70 and a score display panel 74.

Figure 6:
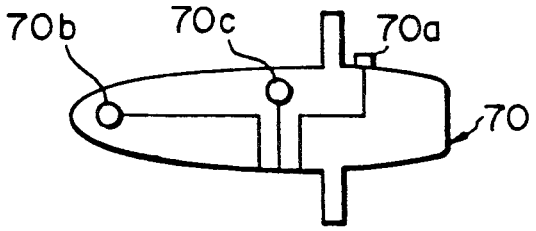

Since it is required in such a case to know which gun 70 emits the beam, the beam guns 70 are adapted to emit beams including different identification codes from one another. Furthermore, the four beam guns 70 are controlled so that each beam gun is slightly out of timing from the other guns on firing. Even if the four beam guns 70 are simultaneously fired, each of the beam guns 70 may be energized out of timing from the other beam guns FIG. 6 shows the concrete structure of a beam gun 70 which includes a trigger switch 70*a*. When the trigger switch 70*a* is turned on, the beam gun 70 causes its fire display LED 70*c* to light on. At the same time, a beam of infrared containing its identification code is emitted from an infrared emitting element 70*b* in the beam gun 70.

If the beam of infrared hits a target T, the sensor 58*b* therein receives the beam of infrared with its identification code to generate a receipt signal which in turn is supplied to the room computer 50.

On receiving the receipt signal, the room computer 50 then generates a hit signal which is supplied to the representation control computer 56. On receiving the hit signal, the representation control computer 56 causes the target T to initiate a behavior so preselected that target T acts when it is hit by the beam of infrared. At the same time, the room computer 50 also transmits this hit signal with the identification code to the room communication unit 50. The room communication unit 50 then causes the transmitter-receiver 54 to wireless transmit the data to the carrier 10.

The carrier 10 receives the data through the transmitting and receiving device 68 and the communication unit 66, the data being then supplied to the computer 60. The computer 60 processes the score of the corresponding player in accordance with the input data and rewrites the score data in the RAM 62. At the same time, the computer 60 causes the score display panel 74 to display new score with respect to the corresponding player.

Figure 7:
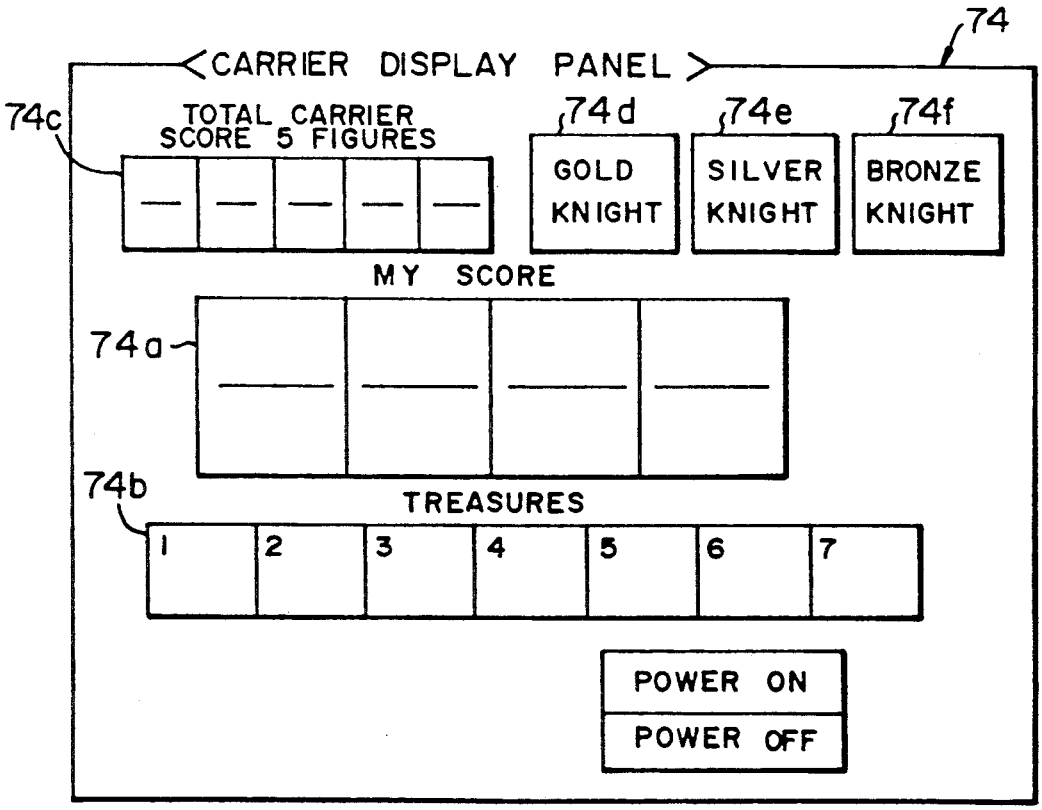

As seen from FIG. 7, the score display panel 74 includes a my score display section 74*a* for displaying scores in the respective players; a treasure display section 74*b* for displaying treasures won by the players; a total carrier score display section 74*c* for displaying the total score of all the players on the same carrier 10; and gold, silver and bronze knight display sections 74*d*, 74*e* and 74*f* for displaying the final scores of the players. Thus, each of the players can confirm his own score and the scores of the other players in the same carrier through viewing the my score display section 74*a*, the treasure display section 74*b* and the total carrier score display section 74*c* during the playing of game. In such a manner, each of the players can compete with the other players on the same carrier in score while trying to increment the total carrier score together with the other players.

In such an arrangement, however, if the contents of the game in the game stages $G_1$–$G_{17}$ are always played in a given representation mode, the players will be easily able to foresee the representation of game in the next game stage when they repeatedly play the game. Therefore, the players would easily have lost interest in playing the game.

The present invention is mainly characterized by that the game representation mode in each game stage G through which a carrier 10 moves or will move is variable depending on the scores of the players.

Even though the players repeatedly play the game, therefore, they can enjoy the game in various game representation modes.

To this end, the illustrated embodiment of the amusement system is so arranged that when a carrier 10 enters each of the game stages G and moves past the carrier position plate 44, it is detected by the sensor 64 which in turn generates a data transmission command to be applied to the computer 60. Immediately when the computer 60 receives this signal, it wireless transmits the score of each of the players stored in the RAM 62 to the transmitting and receiving device 54 in the game stage G through the transmitting and receiving device 68 in the carrier 10. The transmitted data is applied to the room computer 50 which in turn determines a game representation mode. The determined game representation mode is then supplied to the representation control computer 56.

The representation control computer 56 has previously stored a plurality of game representation modes for each of the game stages $G_1$–$G_{17}$. Depending on the command inputted into the representation control computer 56, it sequentially controls the representation of game.

In addition, the computer 60 in each of the carriers 10 also functions as a part of the representing means. More particularly, the computer 60 is adapted to provide changes !n the game representation by increasing or decreasing the Power of a beam gun 70 used by each player, depending on the score of that player which is read out from the RAM 62. For example, if a treasure for increasing the power of a beam gun is set as a target T and when this target T is hit by the beam of that beam gun, the score of a player handling this beam gun will be incremented by one treasure point and stored in the RAM 62. As the carrier 10 enters the next game stage G, the computer 60 increases the power of the beam gun 70 depending on this treasure point. The powering-up of the beam gun 70 enables it to fire two or three times per second, which would otherwise normally fire one time per second.

Thus, the amusement system can provide a multi-scenario game which is variable in representation for each of the game stages, depending on the total carrier score won by the Players thereon. Even if the game is repeatedly played by the players on the carrier, they can always play the game with fresh excitement and enjoyment.

In addition to such a multi-scenario type representation, the amusement system of the present invention is characterized by a multi-ending type representation in which the game completes with a different ending, depending on the total carrier score.

For such a purpose, the travel path of the amusement system may include branch tables $C_1$ and $C_2$ on the respective game stages $G_{13}$ and $G_{14}$ adjacent to the ending of the game.

If the total carrier score does not reach a predetermined level in the game stage $G_{13}$, the carrier 10 will be conducted to the game stages $G_{16}$ and $G_{17}$ through the branch table $C_1$, in which the game is over. At this time, each of the players on the carrier will only obtain a bronze knight title which is in the minimum rank.

On the contrary, if the total carrier score clears the predetermined level in the game stage $G_{13}$, the carrier will advance the game stage $G_{14}$ wherein the players on the carrier can fight new monsters. If the players do not defeat all the monsters, the carrier will be conducted to the game stages $G_{16}$ and $G_{17}$, through the branch table $C_2$, in which the game is over. At this time, each of the players on the carrier can won a silver knight title.

If the players defeat all the monsters in the game stage $G_{14}$, the carrier 10 can advance the final game stage $G_{15}$ and each of the players can win the maximum title, that is, a gold knight.

In such a multi-ending type representation, the titles won by the players may be displayed on the respective knight display sections 74*d*, 74*e* and 74*f* in the display panel 74 within the carrier 10.

Figure 8:
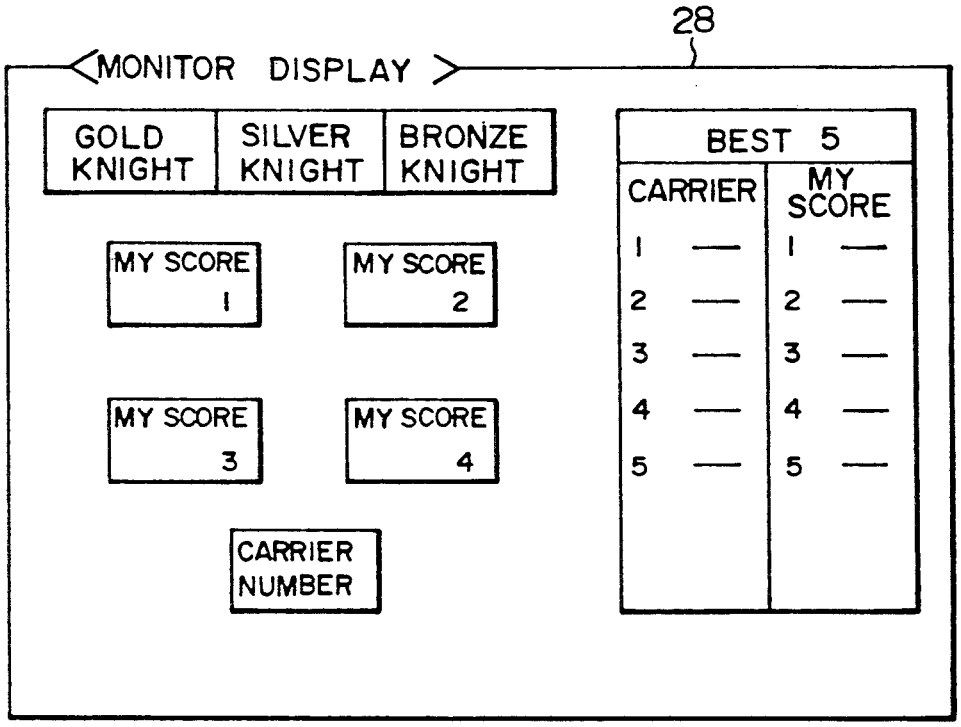

As shown in FIG. 3, the score data of each of the players is transmitted from the room computer 50 of each of the game stages $G_{11}$–$G_{15}$ to the system control computer 22 of the central control room 20 through the LAN. The system control computer 22 then processes the transmitted data to determine the score of each player. These determined scores are displayed on three monitors 28 in the getting-on and -off stations $S_1$ and $S_2$, as shown in FIG. 8. Accordingly, each of the players can compare his own score with the scores of the other players and the best-5 scores in the getting-off station $S_2$. Further, any other players waiting their own carrier in the getting-on station $S_1$ can view the scores of the players which have completed the game.

Figure 9:
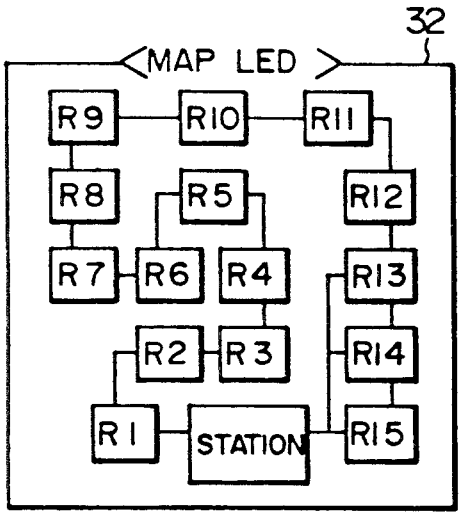
Figure 10:
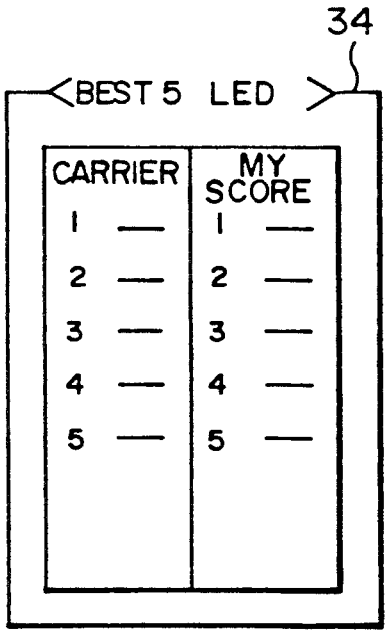

In addition, the outer wall 30 defining the play zone P includes a map display portion 32 for displaying the positions of the moving carriers 10 as shown in FIG. 9 and a score display portion 34 for displaying the best-5 scores as shown in FIG. 10. These outer wall display portions 32 and 34 are controlled by the system control computer 22.

The amusement system may be arranged such that each of the game stages $G_1$–$G_{15}$ has an independent control including the room computer 50, the representation control computer 56 and others, each game stage being capable of operating independently of the other game stages. The system control computer 22 may totally monitor the game stages $G_1$–$G_{15}$ through the LAN through which the data are transmitted and received between the respective game stages.

If any failure occurs, the system control computer 22 can rapidly detect it. Therefore, any failure may be repaired promptly. This can facilitate maintenance and inspection in the entire amusement system.

Even if any one of the game stages $G_1$–$G_{15}$ is in failure, the game can proceed utilizing the remaining game stages since each game stage is independent from the other game stages. This can improve the efficiency of operation in the amusement system.

The system control computer 22 may distribute the total carrier score in the failed game stage to the remaining game stages which are in the normal operation. Thus, the multi-ending score in the game stages $G_{13}$ and $G_{14}$ may be properly estimated.

The infrared transmitter-receiver 54 has a frequency different from those of the adjacent transmitter-receiver 54 such that there will not occur any interference. For example, the frequencies of the transmitter-receiver 54 at the game stages $G_1$, $G_3$, ... $G_{15}$ may be set to be different from those of the game stages $G_2$, $G_4$, ... $G_{14}$.

At each time when a carrier 10 enters a new game stage G, the frequency of the transmitter-receiver 68 thereof is changed into another frequency which is used to perform the transmission and reception of data only between the transmitter-receiver 68 and the corresponding transmitter-receiver 54.

The illustrated embodiment of the amusement system according to the present invention will now be described in operation with respect to a game "Tower of Dole-Urger".

This game is of a multi-scenario and multi-ending type wherein each player acts a role as a hero "Gil" who helps a heroine "Kay" caught by Satan "Dole-Urger". Gil gets on a carrier 10 and wins his power capable of overcoming the power of the final enemy, "Dole-Urger" while fighting various devils and monsters with a beam gun 70.

The game is played by the players in accordance with a story constructed by a multi-scenario representation variable depending on the manner in which the players fight and a multi-ending representation in which if the total carrier score is lower than a predetermined level, the game is over and in which only a true hero can help Kay.

As shown in FIG. 2, each player gets on the carrier 10 and starts the getting-on station $S_1$ to the play zone P in which he fights various enemies with his beam gun 70 and goes to help Kay.

The carrier 10 first reaches the game stage $G_1$. In the game stage $G_1$, two slimes on which Yellow-colored light rolls squirm on the dark floor. If each of the slimes is hit by the beam from the beam gun 70, the color of its body is first changed from one color to another and then disappears (that player wins one hundred points).

The carrier 10 is then advanced to the second game stage $G_2$. In this game stage $G_2$, two slimes emitting red color move upwardly on the wall slowly. As each of the red slimes is hit by the beam from the beam gun 70, it falls onto the floor (that player wins one hundred points).

If all the monsters (slimes) are defeated by the player or players on the carrier 10 in the game stages $G_1$ and $G_2$, they win treasure points such as magic necklaces. The treasure display section **74*b* in the score display panel 74** causes a necklace lamp to turn on, representative of one hundred points. If a player has such a magic necklace, he can unlock a treasure box by the use of the magic necklace when Kay has been helped by the player.

Next, the carrier 10 is moved to the third game stage $G_3$ wherein three "Rockmen" move in a rocking manner, each "Rockman" having an open and clattering mouth and ominously sparkling eyes. Each of the "Rockmen" includes a target T in its mouth. If the target T in the mouth of a "Rockman" is hit by the beam from the beam gun 70, that "Rockman" shouts and puts off the light in its eyes (the player wins two hundred points).

If all the three "Rockmen" are defeated, all the players on the carrier 10 win lamps as treasure points (one lamp being equal to one hundred points). These treasure points are displayed by lighting lamp-shaped marks on the treasure display section **74*b***.

Depending on the total carrier score won by the players on the same carrier 10, the players are given, at the exit of the game stage $G_3$, any significant hint for the next game stage, for example, "a sousara has two lives" or "if all sousaras are defeated, you can win a magic handbook".

After the carrier 10 has passed through the game stage $G_4$ while defeating the targets T and when it is moved into the next game stage $G_5$, the players encounter four sousaras before flames. Each of the sousaras is a monster which has shining red eyes viewed through a gap in a mantle and a pendant suspended from its neck. If the pendant is hit by the beam from the beam gun one time, its color changes from one to another. If the pendant is hit by the beam two times, the flames disappear and the face of that sousara varies into a skull face (one defeated sousara being equal to one-two hundred points).

If the players on the same carrier 10 is given one of the aforementioned hints, "a sousara has two lives" in the game stage $G_3$, they can efficiently defeat the sousaras since all the players on the carrier have already known that each sousara can be defeated only by two hits.

If all the four sousaras are defeated, all the players on the carrier 10 are given magic handbooks as treasure points (a magic handbook corresponds to two hundred points). Moreover, each of the players is given a hint, "you must not attack any green bright thing", from his magic handbook. Such a hint is important to increase the score in the subsequent game stages.

As the carrier 10 enters the sixth game stage $G_6$, the players encounter two small and green bottles shining on a shelf. These bottles contain a poison. If a player attacks the bottles, he will lose many points (one bottle corresponds to minus two hundred points).

Therefore, only a player can avoid loss of his points, who has been given said hint from the magic handbook in the fifth game stage $G_5$.

After the carrier 10 has successfully moved through the game stages $G_7$–$G_{10}$ and when it enters the game stage $G_{11}$ or $G_{12}$ which is one of the most difficult stages, the players encounters a dragon having a vertically moving head and a horizontally moving tail. The dragon has vital points at its head, forelegs and tail. If any one of these vital points is hit by the beam from the beam gun, the red color of the dragon's eyes changes to green color. Substantially at the same time, the dragon shouts and disappears (points won by the defeat of the dragon being equal to two or eight hundred points). If the dragon is defeated, all the players on the carrier 10 are given treasure points which are displayed in the form of a key of hope on the treasure display section **74*b*** (one key of hope corresponding to two hundred points).

The carrier 10 then enters the game stage $G_{13}$. If the players defeat a dragon, all of them are given a title of silver knight. This means that the total carrier score reaches four or more thousand points. Only in such a situation, the players can open the brave's door and advance the game stage $G_{14}$.

In the other cases, the game is over. The players are only given the lowest-ranked title, "bronze knight". The carrier on which they ride is separately conducted to the game stages $G_{16}$ and $G_{17}$ through the branch table $C_1$ and finally returned to the getting-off station $S_2$ through the shame road.

When the carrier 10 opens the brave's door and enters the game stage $G_{14}$, the players on the carrier 10 must fight Dole-Urger. Dole-Urger sits on a chair and two skeletons stay on the opposite walls about the chair (one skeleton corresponding to one hundred points). Dole-Urger has eight moving arms, three of which are vital points. Dole-Urger also has another vital point at a pendant which is suspended from the neck and becomes invisible from time to time (Dole-Urger corresponding to two–four hundred points).

If the players on the carrier 10 defeat Dole-Urger, they are given a crystal rod which enables the players to help Kay in the next game stage $G_{15}$. If the players do not defeat Dole-Urger, the carrier 10 is moved to the game stages $G_{16}$ and $G_{17}$, with the players thereon being given a title of silver knight. Further, the carrier 10 will be returned to the getting-off station $S_2$, through the defeated road in which the players are scorned by Dole-Urger.

After the players defeat Dole-Urger and as the carrier 10 reaches the final game stage $G_{15}$, they can find Kay caught by Dole-Urger. Kay holds a crystal rod at her hand. The players, which have won the magic necklaces as treasure points, can open a treasure box. At this time, all the players on the carrier 10 are given two hundred points and also the highest title of gold knight with special points (equal to three hundred points).

After the players on the carrier 10 have completed their fight, the carrier 10 is returned to the getting-off station $S_2$. As shown in FIG. 8, the getting-off station $S_2$ displays the score of each of the players, the titles given to all the players on the carrier 10 (gold knight, silver knight and bronze knight). Thus, the players can enjoy the game ending while viewing their scores and titles.

In this embodiment, further, the aforementioned treasure Points may be more positively utilized as game representing points. For example, if a treasure point is won by any player on the carrier, such a treasure point may be utilized to change the game representation mode from one to another in a game stage through which the carrier is moving or will move. More particularly, there may be provided any special target appearing only when such a treasure point is won by the player on the carrier. This will aid the change of game representation mode.

The present invention is not limited to the aforementioned embodiment, but may be carried out in various other arrangements and/or representations within the scope of the invention.

Although the present invention has been described as to a single rail 12 extending through the game stages $G_1$–$G_{13}$, it may be applied to such an embodiment that the rail 12 is branched into one or more branch rail sections in the game stages $G_1$–$G_{13}$. Thus, the carrier 10 may be selectively conducted to any one of the branch rail sections which leads to a game stage represented in a different mode, depending on the total carrier score.

Figure 11:
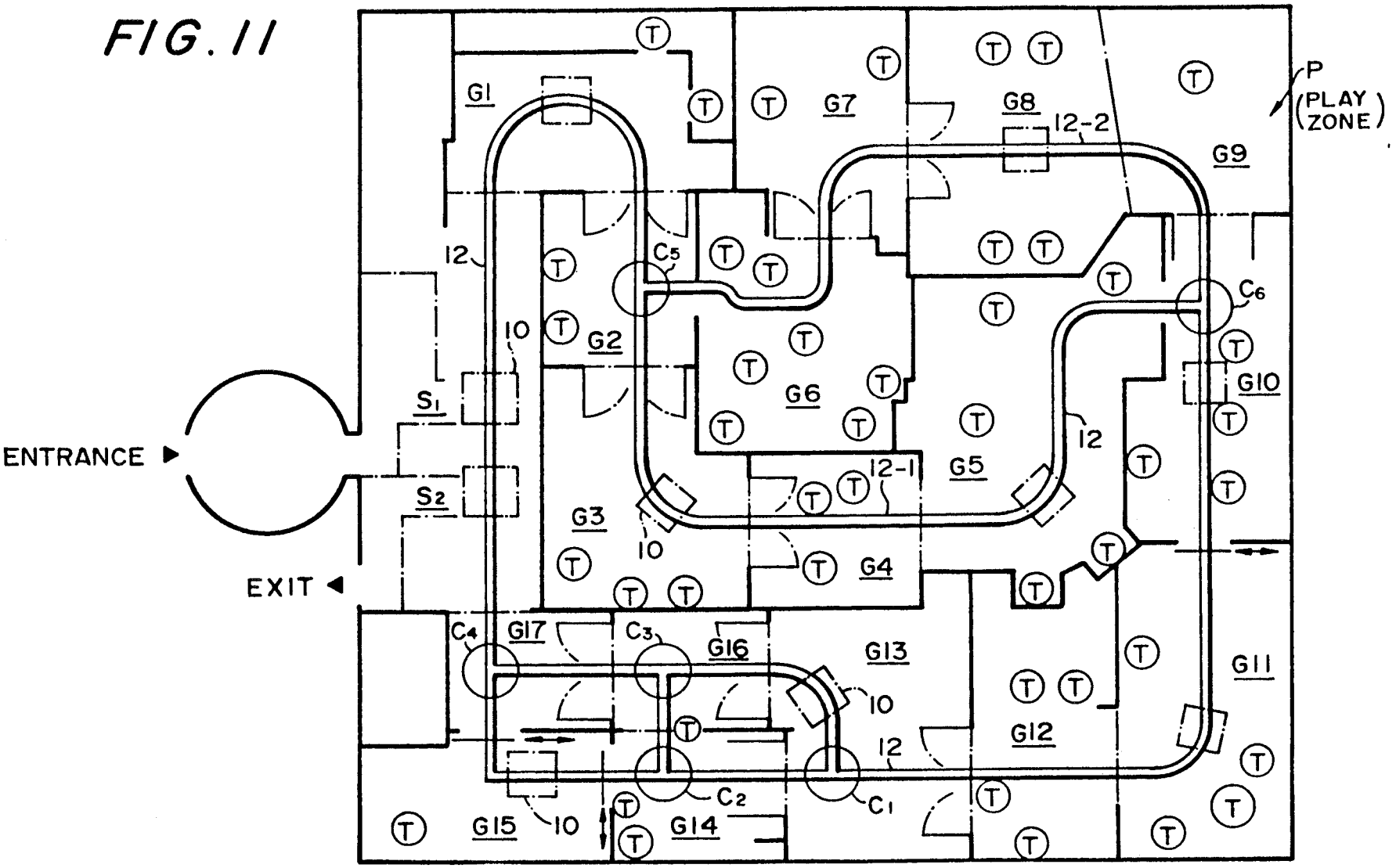
FIG. 11 illustrates another embodiment of an amusement system constructed in accordance with the present invention.

FIG. 11 exemplifies such an arrangement wherein the game stages $G_2$ and $G_{10}$ include branch tables $C_5$ and $C_6$, respectively. The rail 12 is branched into two rail sections 12-1 and 12-2 at the game stage $G_2$. The two rail sections 12-1 and 12-2 are merged into the rail 12 at the game stage $G_{10}$.

One of the branched rail sections 12-1 extends through the game stages $G_3$, $G_4$ and $G_5$ while the other rail section 12-2 extends through the game stages $G_6$, $G_7$, $G_8$ and $G_9$.

As the carrier 10 enters the branch table $C_5$ in the game stage $G_2$, it is temporally stopped for a period of time during which data relating to the total carrier score in that carrier 10 is transmitted and received between the carrier 10 and the room computer 50 located in the game stage $G_2$.

Based on the total carrier score received, the room computer 50 determines a branch rail section for the carrier to be conducted and provides a branch selection command to the carrier controller 26.

In this embodiment, the carrier controller 26 functions as part of the game representation means. When the carrier controller 26 receives the branch selection command, it actuates the branch table $C_5$ so that the carrier 10 will be selectively conducted to either of the branch rail section 12-1 or 12-2.

In such a manner, this embodiment can cause the carrier to move onto any given one of the game stages in which the scene of game is played in a different representation mode, depending on the total carrier score.

In this embodiment, only a single representation mode may be set at each of the game stages $G_1$–$G_{15}$. However, a plurality of game representation modes may be set at each of the game stages $G_1$–$G_{15}$ to provide a more varied stage effect in each game stage, as in the first embodiment.

In accordance with the principle of the present invention, it is to be understood that the rail 12 includes more branch rail sections rather than two as described, if necessary.

The carrier 10 running on the rail 12 may be replaced by any other travelling means which can move on and along a given travel path. For example, the carrier 10 may be replaced by a vehicle running on roads in the play zone or a ship or boat moving within channels provided in the play zone.

Although the previous embodiments have been described as to the use of infrared beam gun 70, it may be replaced by any other shooting means. If only one player is adapted to get on the carrier means, any model gun launching BB bullets may be used in place of such a beam gun.

Although the previous embodiments have been described as to the connection of the system control computer 22 in the central control room 20 with the room computer 50 in each of the game stages G through the LAN, all the processing and controlling may be performed only by the system control computer 22 without use of the room computers 50 and the representation control computer 56. In such a case, the system control computer 22 may be actuated under time sharing technique to control the shooting and representing operations in each of the game stages $G_1$–$G_{17}$.

Although the previous embodiment has been described as to the shooting game, the present invention may be applied to various other types of games, that is, a game wherein balls are thrown against targets to compete for score between players at each game stage; another game wherein players answer quizes provided at each of the game stages to increment their scores; and a further game wherein each player holds a hammer as in the mole beating game and beats targets such as monsters appearing at each of the game stages to increment his score.

As will be apparent from the foregoing, the present invention provides an amusement system in which a player or players can enjoy the game with more amusement since the player or players on the carrier travelling in the play zone can confirm his own score or their own scores at real time while playing the game.

The present invention provides a play zone consisting of a plurality of game stages in combination and adopts a new arrangement in which depending on the total carrier score, the game representation mode is variable at a game stage through which the carrier is moving or will move. Even if the players repeatedly play the game, therefore, they will not have lost interest in playing since the players can encounter various different representations at the respective game stages.

Particularly, a large-scaled amusement system which utilizes carriers moving along a given travel path has very important subject that does not cause many players to have lost interest in playing. The present invention is extremely effective for such a large-scaled amusement system.

We claim:

1. An amusement system comprising:

a play zone comprising a plurality of games stages and including a travel path extending through the respective game stages;

carrier means for receiving a player or players thereon and for moving along said travel path while allowing the player or players to play a game;

score processing means for computing at least one score, said at least one score including at least one of a total carrier score and at least one score of each player, said at least one score being based on a player's or player's game playing performance; and representing means for controlling presentation modes of the game; wherein at least one of said game stages is variable in game presentation mode; and wherein said representing means changes the game presentation mode at said variable game presentation mode game stage through which said carrier means is moving or will move, depending on a score comprising at least one of the total carrier score and the at least one score of each player, whereby there can be provided a multi-scenario game.

2. An amusement system as defined in claim 1 wherein said travel path branches into different travel path sections and wherein depending on the total carrier score, said representing means changes the game presentation mode by directing said carrier means into one of said different travel path sections.

3. An amusement system as defined in claim 1 wherein: at least one of said game stages comprises target means; said carrier means comprises shooting means for shooting said target means; and said score processing means detects any hit of said target means to compute the score of a player who shot said target means.

4. An amusement system as defined in claim 3 wherein said travel path branches into different path sections at a game stage adjacent to a game ending, said carrier means being capable of moving along any one of said different travel path sections and reaching any one of separate game finish points and wherein said representing means selects a travel path section through which said carrier means is to be moved, to provide a multi-ending game having different potential game endings, depending on the total carrier score.

5. An amusement system as claimed in claim 4 wherein each of said carrier means includes a plurality of shooting means which can be utilized to shoot the target means by a plurality of players, each of said shooting means emitting a beam including a unique identification code, the target means being adapted to provide a hit detection signal for each player based on the identification code which is included in the beam hitting the target means, said score processing means being adapted to compute and display the score of each of the players on the same carrier means and to total the scores of the players, based on the number of detected hit detection signals, and said representing means being adapted to change the game presentation mode at a game stage through which the carrier means is moving or will move, depending on the total carrier score computed by said score processing means.

6. An amusement system as defined in claim 3, further comprising a first transmitter-receiver located in each of said game stages; and a second transmitter-receiver located in each of said carrier means and adapted to perform the transmission and reception of data between said first and second transmitter-receivers and wherein said target means is adapted to transmit a hit detection signal to the second transmitter-receiver through the first transmitter-receiver and wherein said score processing means is located in each of said carrier means and adapted to compute the score of player or the scores of the players based on a hit detection signal received through the second transmitter-receiver and to display the computed score or scores on display means.

7. An amusement system as claimed in claim 3 wherein each of said carrier means includes a plurality of shooting means which can be utilized to shoot the target means by a plurality of players, each of said shooting means emitting a beam including a unique identification code, the target means being adapted to provide a hit detection signal for each player based on the identification code which is included in the beam hitting the target means, said score processing means being adapted to compute and display the score of each of the players on the same carrier means and to total the scores of the players, based on the number of detected hit detection signals, and said representing means being adapted to change the game presentation mode at a game stage through which the carrier means is moving or will move, depending on the total carrier score computed by said score processing means.

8. An amusement system as defined in claim 3 wherein said play zone includes at least one game stage having at least one target corresponding to a treasure point which can be won by a player on the carrier and wherein depending on the content of said won treasure point, said representing means changes the game presentation mode in a game stage through which the carrier is moving or will move.

9. An amusement system as defined in claim 1 wherein said travel path branches into different path sections at a game stage adjacent to a game ending, said carrier means being capable of moving along any one of said different travel path sections and reaching any one of separate game finish points and wherein said representing means selects a travel path section through which said carrier means is to be moved, to provide a multi-ending game having different potential game endings, depending on the total carrier score.

10. An amusement system as defined in claim 1 wherein said travel path branches into different path sections at a game stage adjacent to ending, said carrier means being capable of moving along an of said different travel path sections and reach any one of separate game finish points and wherein said representing means selects a travel path section through which said carrier means is to be moved, to provide a multi-ending game having different potential game endings, depending on the total carrier score.

11. An amusement system as defined in claim 1, further comprising a carrier entry sensor located at the entry of each of said game stages and wherein at each time when said carrier entry sensor detects the entry of the carrier means into the game stage, said representing means reads out the total carrier score from said score processing means and changes the game presentation mode at the game stage through which said carrier means is moving, depending on the total carrier score.

12. An amusement system as defined in claim 1 wherein said representing means selects from a plurality of game presentation modes preset for each game stage, said representing, means being adapted to select one of said game presentation modes, depending on the total carrier score.

13. An amusement system comprising:

a play zone comprising a plurality of game stages and including a travel path extending through the respective game stages;

carrier means for receiving a player or players thereon and for moving along said travel path while allowing the player or players to play a game;

score processing means for computing at least one score, said at least one score including at least one of a total carrier score and at least one score of each player, said at least one score being based on the player's or players' game playing performance; and representing means for controlling presentation modes of the game; wherein said travel path branches into different travel path sections; and wherein depending on a score comprising of at least one of the total carrier score and the at least one score of teach player, said representing means changes the game presentation mode by directing said carrier means into one of said different travel path sections, whereby there can be provided a multi-scenario game.

14. An amusement system as defined in claim 13 wherein: at least one of said game stages comprises target means; said carrier means comprises shooting means for shooting said target means; and said score processing means detects any hit of said target means to compute the score of a player who shot said target means.

15. An amusement system as defined in claim 14 wherein said travel path branches into different path sections at a game stage adjacent to a game ending, said carrier means being capable of moving along any one of said different travel path sections and reaching any one of separate game finish points and wherein said representing means selects a travel path section through which said carrier means is to be moved, to provide a multi-ending game having different potential game endings, depending on the total carrier score.

16. An amusement system as defined in claim 14 wherein said play zone includes at least one game stage having at least one target corresponding to a treasure point which can be won by a player on the carrier and wherein depending on the content of said won treasure point, said representing means changes the game presentation mode in a game stage through which the carrier is moving or will move.

* * * * *